US010145141B2

(12) United States Patent
Lovley, II

(10) Patent No.: US 10,145,141 B2
(45) Date of Patent: Dec. 4, 2018

(54) COLLAPSIBLE CANOPY

(71) Applicant: ShelterLogic Corp., Watertown, CT (US)

(72) Inventor: Jack B. Lovley, II, Lake Forest, CA (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 14/969,539

(22) Filed: Dec. 15, 2015

(65) Prior Publication Data

US 2016/0168874 A1 Jun. 16, 2016

Related U.S. Application Data

(60) Provisional application No. 62/092,117, filed on Dec. 15, 2014.

(51) Int. Cl.

| | |
|---|---|
| ***E04H 15/60*** | (2006.01) |
| ***E04H 15/50*** | (2006.01) |
| ***E04H 15/46*** | (2006.01) |

(52) U.S. Cl.

CPC ..... *E04H 15/60* (2013.01); *E04H 15/46* (2013.01); *E04H 15/50* (2013.01); *E04H 15/505* (2013.01)

(58) Field of Classification Search

CPC ..... E04H 15/46; E04H 15/50; E04H 15/60; Y10T 403/32467; Y10T 403/32475;

(Continued)

(56) References Cited

U.S. PATENT DOCUMENTS 1,801,014 A * 4/1931 Lange ..... E04H 15/46 135/117
3,987,807 A * 10/1976 Varnell ..... A45B 1/04 135/22

(Continued)

FOREIGN PATENT DOCUMENTS

| | | | | |
|---|---|---|---|---|
| CN | 202706662 U | | 1/2013 | |
| GB | 810195 A | * | 3/1959 | ..... A45B 19/04 |
| WO | WO 2010149883 A1 | * | 12/2010 | ..... A45B 3/12 |

OTHER PUBLICATIONS

English translation of WO 2010149883 A1 from espacenet.com.*

*Primary Examiner* — David R Dunn
*Assistant Examiner* — Danielle Jackson
(74) *Attorney, Agent, or Firm* — Carmody Torrance Sandak & Hennessey LLP

(57) ABSTRACT

A collapsible canopy has a collapsible frame and a canopy cover supported by the collapsible frame. In some configurations, the frame includes telescopic legs having three or more stages. An automatic lock release is carried by one of the legs and automatically releases a lock between two other of the legs. A relative inner leg can include a cap having a resilient portion that contacts an inner surface of a relative outer leg to increase a lateral rigidity of the leg assembly. At least one of the eave cross members can have an end portion having an abutting extension that contacts an adjacent cross member to limit lateral deflection of the eave. The abutting extension can be positioned between eave cross members that incorporate a bracket for supporting a center support that extends from the eave toward a center or interior of the canopy.

14 Claims, 10 Drawing Sheets

(58) Field of Classification Search
CPC ..... Y10T 403/32483; Y10T 403/32516; A45B 2009/007
See application file for complete search history.

(56) References Cited

U.S. PATENT DOCUMENTS 5,199,811 A * 4/1993 Huang ..... B62B 1/125 248/333
6,508,262 B1 * 1/2003 Takayama ..... E04H 15/50 135/114
7,066,676 B2 6/2006 Tsai
7,849,867 B2 * 12/2010 Takayama ..... E04H 15/60 135/114
7,967,259 B2 * 6/2011 Nakatani ..... F16B 7/042 248/125.8
8,590,553 B2 * 11/2013 Lovley, II ..... E04H 15/46 135/120.2
8,662,096 B2 * 3/2014 Stehly ..... E04H 15/50 135/114
9,103,138 B2 8/2015 Lovley, II
9,279,269 B2 * 3/2016 Lovley, II ..... E04H 15/32
9,683,387 B2 6/2017 Lovley, II
2002/0074032 A1 * 6/2002 Park ..... E04H 15/50 135/131
2005/0205124 A1 * 9/2005 Goldwitz ..... E04H 15/50 135/131
2007/0012346 A1 * 1/2007 Choi ..... E04H 15/60 135/114
2009/0071521 A1 3/2009 Sy-facunda
2010/0122718 A1 * 5/2010 Lah ..... A45B 9/00 135/75
2014/0190541 A1 7/2014 Lovley, II et al.
2016/0002949 A1 * 1/2016 Yang ..... E04H 15/50 135/139

* cited by examiner

COLLAPSIBLE CANOPY

RELATED APPLICATION

This application claims priority to U.S. Provisional Patent Application No. 62/092,117, filed Dec. 15, 2014, the entire contents of which are incorporated herein by reference in its entirety.

BACKGROUND

Field

The present disclosure relates to collapsible canopies and, in particular, canopy frames having improved canopy frames and related frame components.

Description of the Related Art

Canopy shelters with collapsible frames are commonly used to provide portable shelter for outdoor activities such as camping, picnicking, parties, weddings, and more. Such collapsible canopy shelters typically comprise a canopy cover and a canopy frame configured to stand alone when in an expanded or deployed state and to collapse into a collapsed state for storage and transport.

While conventional canopy shelters are useful for a variety of purposes, such as providing portable shade and/or shelter from the elements and providing an aesthetically pleasing backdrop for special events, conventional canopy frames leave room for improvement with respect to structural integrity. Some conventional canopy frame designs are vulnerable to misalignment, excessive friction, and twisting, which make the canopy difficult to expand and collapse.

Canopy frames are generally constructed of cross members that pivot relative to one another during expansion and collapse of the frame. In certain configurations, particularly in a canopy frame including a center lift tube, perpendicular cross members (e.g., edge and interior members) come together at a T point. Some canopy frames utilize a bracket at the T point to position one cross member generally perpendicular to at least one additional cross member.

SUMMARY

The systems, methods and devices described herein have innovative aspects, no single one of which is indispensable or solely responsible for their desirable attributes. Without limiting the scope of the claims, some of the advantageous features will now be summarized.

According to some embodiments, a collapsible canopy comprises a collapsible frame comprising at least one telescopic leg, the at least one telescopic leg comprising a first leg segment, a second leg segment and at least a third leg segment, wherein the second leg segment is situated below the first leg segment and is configured to slide at least partially within an interior of the first leg segment, wherein the third leg segment is situated below the second leg segment and is configured to slide at least partially within an interior of the second leg segment, a first lock positioned along or near a lower end of the first leg segment, the first lock being configured to lockingly engage the first leg segment relative to the second leg segment, a second lock positioned along or near a lower end of the second leg segment, the second lock being configured to lockingly engage the second leg segment relative to the third leg segment, a collapsible canopy cover supported by the collapsible frame, and a lock release (e.g., an automatic lock release) carried by the first leg segment, wherein the automatic lock release is configured to release the second lock once the first lock is released and the second leg segment slidably moves within the first leg segment.

According to some embodiments, the automatic lock release is configured to release the second lock when the automatic lock release at least partially contacts the second lock. In some embodiments, the second lock comprises a push pin lock, wherein the automatic lock release is configured to activate the push pin lock upon contact between the automatic lock release and the second lock so as to permit relative movement between the second leg segment and the third leg segment. In other embodiments, the second lock comprises another type of lock having at least one lever or other member that is manipulated to release or otherwise actuate the lock.

According to some embodiments, the automatic lock release comprises a protruding member, wherein the protruding member is configured to contact and engage at least a portion of the second lock. In some embodiments, the protruding member comprises a ramped, sloped, angled or other tapered surface. In some embodiments, the protruding member is situated along the same side of the at least one telescopic leg as the second lock. In one embodiment, the first lock is situated along a different side of the at least one telescopic leg than the second lock.

According to some embodiments, the collapsible frame comprises four telescopic legs, wherein each of said telescopic legs comprises an automatic lock release along a first leg portion of said telescopic leg.

According to some embodiments, a collapsible canopy includes a collapsible frame comprising at least one telescopic leg, the at least one telescopic leg comprising a first leg segment, a second leg segment and at least a third leg segment, wherein the second leg segment is situated below the first leg segment and is configured to slide at least partially within an interior of the first leg segment, wherein the third leg segment is situated below the second leg segment and is configured to slide at least partially within an interior of the second leg segment, a first lock positioned along or near a lower end of the first leg segment, the first lock being configured to lockingly engage the first leg segment relative to the second leg segment, a second lock positioned along or near a lower end of the second leg segment, the second lock being configured to lockingly engage the second leg segment relative to the third leg segment;

a lock release assembly carried by the first leg segment, wherein the lock release assembly is configured to contact the second lock and release said second lock to permit the third leg segment to move relative to the second leg segment.

According to some embodiments, the lock release assembly is configured to release the second lock when the lock release assembly at least partially contacts the second lock. In some embodiments, the second lock comprises a push pin lock, wherein the lock release assembly is configured to activate the push pin lock upon contact between the lock release assembly and the second lock so as to permit relative movement between the second leg segment and the third leg segment.

According to some embodiments, the lock release assembly comprises a protruding member, wherein the protruding member is configured to contact and engage at least a portion of the second lock. In some embodiments, the protruding member comprises a ramped, sloped, angled or other tapered surface. In one embodiment, the protruding member is situated along the same side of the at least one telescopic leg as the second lock.

According to some embodiments, a telescopic leg (e.g., configured for use with a collapsible canopy, tripod or other stand, any other collapsible member or device, etc.) comprises a first leg segment, a second leg segment, at least a third leg segment, wherein the second leg segment is situated below the first leg segment and is configured to slide at least partially within an interior of the first leg segment, wherein the third leg segment is situated below the second leg segment and is configured to slide at least partially within an interior of the second leg segment, a first lock positioned along or near a lower end of the first leg segment, the first lock being configured to lockingly engage the first leg segment relative to the second leg segment, a second lock positioned along or near a lower end of the second leg segment, the second lock being configured to lockingly engage the second leg segment relative to the third leg segment, and a lock release carried by the first leg segment, wherein the lock release is configured to release the second lock once the first lock is released and the second leg segment slidably moves within the first leg segment.

According to some embodiments, the lock release is configured to release the second lock when the lock release at least partially contacts the second lock. In some embodiments, the second lock comprises a push pin lock, wherein the lock release is configured to activate the push pin lock upon contact between the lock release and the second lock so as to permit relative movement between the second leg segment and the third leg segment. In other embodiments, the second lock comprises another type of lock having at least one lever or other member that is manipulated to release or otherwise actuate the lock.

According to some embodiments, the lock release comprises a protruding member, wherein the protruding member is configured to contact and engage at least a portion of the second lock. In some embodiments, the protruding member comprises a ramped, sloped, angled or other tapered surface. In some embodiments, the protruding member is situated along the same side of the at least one telescopic leg as the second lock. In several embodiments, the first lock is situated along a different side of the at least one telescopic leg than the second lock.

According to some embodiments, a collapsible canopy comprises a collapsible frame, and a canopy cover supported by the collapsible frame, wherein the frame comprises at least one telescopic leg, the at least one telescopic leg comprises a first leg segment and at least a second leg segment, wherein the second leg segment is configured to slidably move within the first leg segment, wherein a first end of the second leg segment is configured to be slidably positioned within an interior cavity of the first leg segment, wherein the second leg segment comprises a cap along the first end, the cap comprising at least one resilient portion to permit a perimeter of the cap to at least partially radially expand, and wherein the cap is configured to contact an inner surface of the first leg segment to increase a lateral rigidity of the at least one telescopic leg, and wherein the cap is configured to at least partially radially retract inwardly when the second leg segment is moved relative to the first leg segment.

According to some embodiments, the at least one telescopic leg comprises a rectangular shape, wherein the cap comprises a resilient portion along at least one side. In some embodiments, the cap comprises a resilient portion along three sides. In some embodiments, the at least one resilient portion the cap comprises a gap formed adjacent at least one peripheral edge of the cap to permit the at least one peripheral edge of the cap to flex inwardly and outwardly. In some embodiments, the cap comprises plastic and/or another resilient material. In some embodiments, the cap is configured to be normally resilient biased outwardly so that an outer surface of the cap at least partially contacts an inner surface of the first leg segment when the second leg segment is stationary relative to the first leg segment.

According to some embodiments, a collapsible canopy comprises a collapsible frame having a plurality of eave portions and at least one inner cross member, each eave portion comprising at least a pair of outer cross members, and a canopy cover supported by the collapsible frame, wherein at least one of the outer cross members comprises an end portion comprising an abutting extension that extends toward or contacts an adjacent outer cross member to limit lateral deflection of the outer cross members of the eave portion.

An aspect of the present application involves the realization that brackets used at a T-point, in order to provide sufficient strength, can have a thickness that spaces the parallel cross members at an excessive distance from one another when the bracket is positioned between the cross members. As a result, excessive lateral movement can result between the cross members. In some configurations, at least one of the cross members includes an end portion having an abutting protrusion that extends toward the parallel cross member to at least partially fill a gap between the cross members to limit lateral movement therebetween.

A collapsible canopy has a collapsible frame and a canopy cover supported by the collapsible frame. In some configurations, the frame includes telescopic legs having three or more stages. An automatic lock release is carried by one of the legs and automatically releases a lock between two other of the legs. A relative inner leg can include a cap having a resilient portion that contacts an inner surface of a relative outer leg to increase a lateral rigidity of the leg assembly. At least one of the eave cross members can have an end portion having an abutting extension that contacts an adjacent cross member to limit lateral deflection of the eave. The abutting extension can be positioned between eave cross members that incorporate a bracket for supporting a center support that extends from the eave toward a center or interior of the canopy.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION

Figure 1:
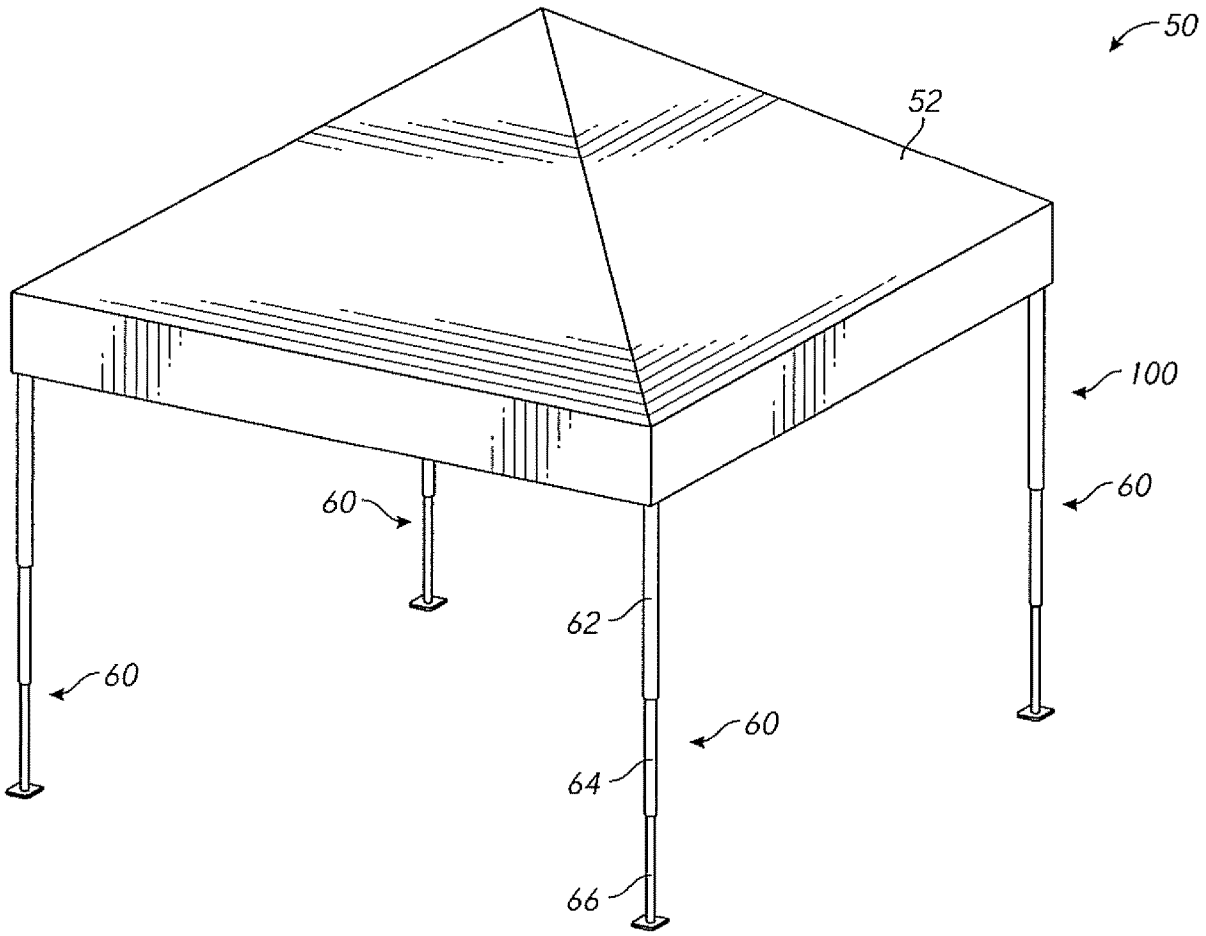
FIG. 1 illustrates a perspective view of one type of collapsible canopy having a frame and a canopy cover.

FIG. 1 illustrates a perspective view of a collapsible canopy 50 according to one embodiment. As shown, the canopy 50 can include a canopy frame 100 and a canopy cover 52 that is supported by the frame 100 and provides protection to users against sun, rain and/or other elements. In some embodiments, the frame 100 includes an upper portion (e.g., hidden by cover 52 in the arrangement depicted in FIG. 1) and a plurality of leg assemblies or legs 60 that support the upper portion of the frame 100 and the cover 52 at a height above the ground or a surface upon which the canopy 50 is rested. In the illustrated arrangement, the legs 60 are multi-portion, telescopic legs having multiple (e.g., two, three, more than three, etc.) leg members that extend and retract relative to one another. In some configurations, the legs 60 include at least three telescoping leg members 62, 64, 66. Typically, in some embodiments, one end leg (e.g., upper leg 62) will be an outermost leg and the opposite end leg (e.g., lower leg 66) will be an innermost leg, with the intermediate leg (e.g., leg 64) or legs received between the outermost and innermost leg. Any two of the legs can be described as relative outer and relative inner legs based on the relative position of the legs to one another. Similarly, any two of the legs can be described as relative upper and lower legs.

Figure 2:
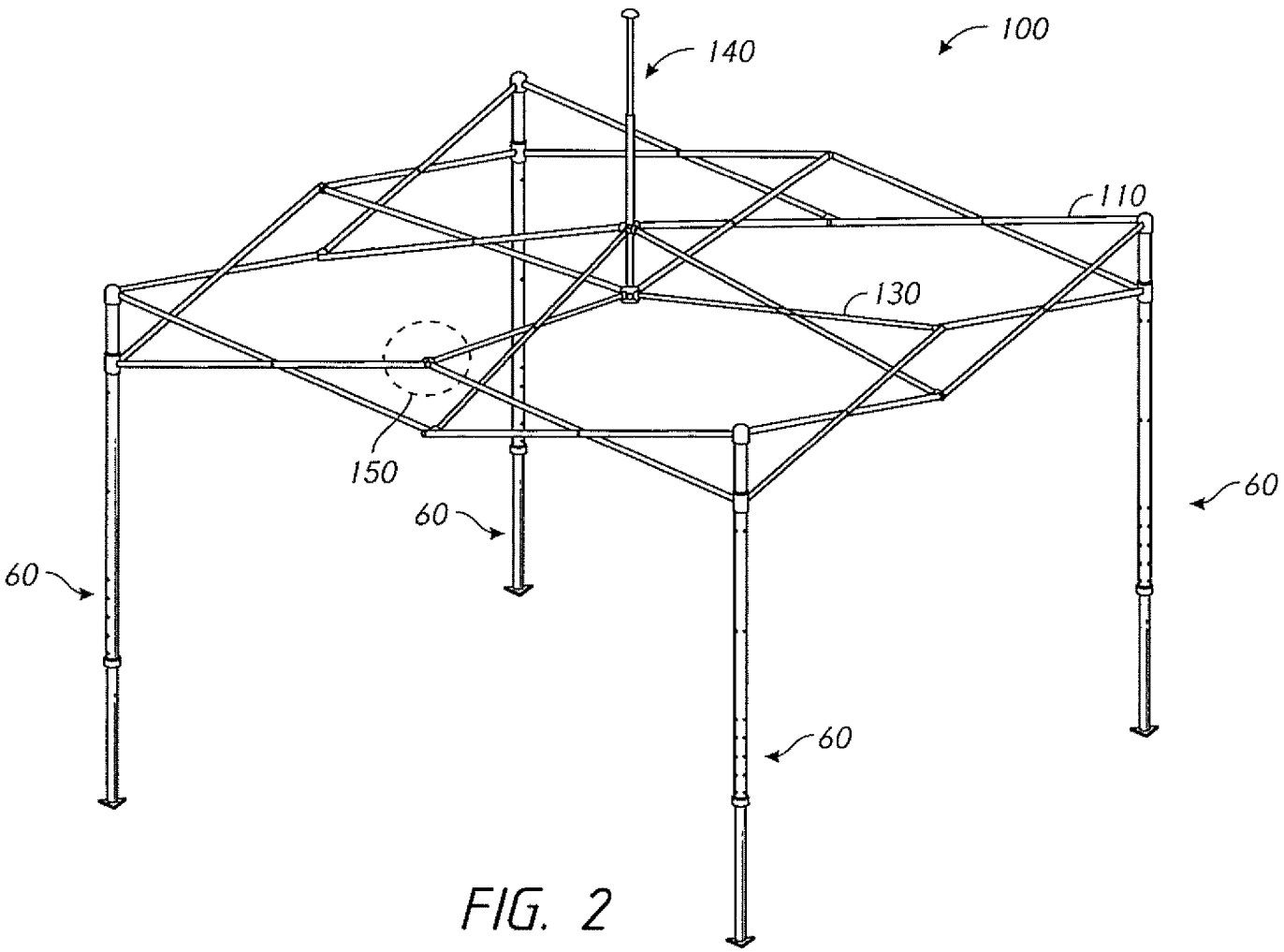
FIG. 2 illustrates a perspective view of the collapsible canopy frame of the canopy of FIG. 1. The frame includes an upper portion having a plurality of cross members and a plurality of legs that support the upper portion.

FIG. 2 illustrates a perspective view of one embodiment of a collapsible canopy frame 100. In one configuration, as shown, the collapsible canopy frame 100 comprises a plurality cross members 110, 130 arranged and pivotally coupled such that the canopy frame 100 may be expanded and collapsed between an expanded state and a collapsed state. One embodiment of a canopy frame is described in US Patent Publication No. 2009/0071521 to Sy-Facunda, the entirety of which is hereby incorporated by reference herein in its entirety and made a part of the present specification. In some embodiments, the canopy frame 100 comprises an interior support or lift tube (e.g., a center support or center lift tube 140) configured to support an interior portion (e.g., the center) of the canopy cover 52 in an expanded state. In a square canopy arrangement, the interior support may be a center support. In a rectangular canopy embodiment, the interior support can be off-center, as desired or required. In particular, multiple interior supports can be provided in a rectangular canopy, with the interior supports often centered in the small dimension direction and evenly spaced along the large dimension direction. Multiple interior supports can be provided in any shape canopy, if desired. The term "center support" or "center lift tube" is used herein for convenience and can include any interior support unless indicated otherwise.

In some embodiments, the canopy frame 100 comprises a plurality of outer cross members 110 throughout the edge or perimeter of the canopy frame 100. The canopy frame 100 can further comprise a plurality of inner cross members 130 within the interior or perimeter of the canopy frame 100. In one embodiment, the inner cross members 130 are pivotally coupled to at least one outer cross member 110 and the center lift tube 140. As described herein, in some embodiments, the canopy frame 100 comprises more than one center lift tube (not illustrated). In some embodiments, the inner cross members may pivotally couple to multiple center lift tubes (not illustrated). In some embodiments, a plurality of inner cross members 130 may couple the outside cross members 110 to the center lift tube 140.

Figure 3A:
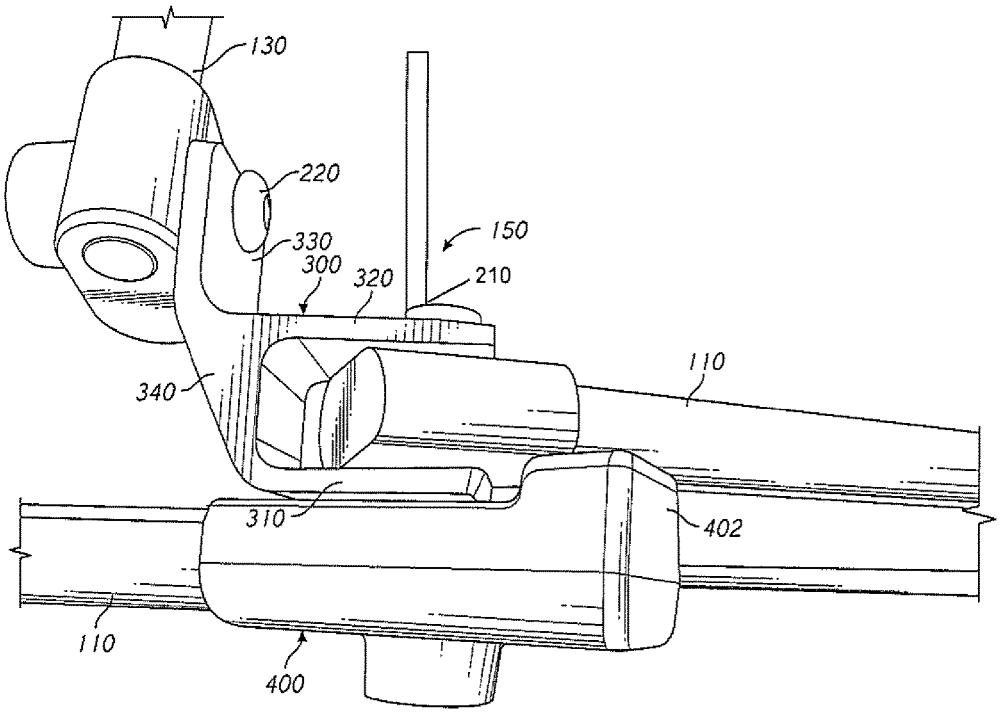
FIG. 3A illustrates a top plan view of an upper T-point between a pair of parallel cross members and an interior cross member incorporating an F-bracket. One of the parallel cross members includes an end portion having an abutting extension that extends toward the other of the parallel cross members.

FIG. 3A illustrates a top view of a portion of one type of collapsible canopy frame 100. In one embodiment, as illustrated in the depicted embodiment, a first outer cross member 110 is pivotally coupled to a second outer cross member 110 at a T-point 150. An inner cross member 130 is pivotally coupled to the T-point 150 by way of a bracket 300. The inner cross member 130 is generally or substantially perpendicular to the first outer cross member 110 and second outer cross member 112 from a top view. The cross members 130 can be upper members of an X-eave configuration or lower members of an X-eave configuration, for example. The term "T-point" as used herein refers to the meeting of one support element or member with one or more other, non-parallel support element(s) or member(s). At least two of the support elements or members can be generally, substantially or exactly perpendicular to one another.

The illustrated bracket is an F-bracket 300 is configured to pivotally couple the inner cross member 130 to both the first outer cross member 110 and second outer cross member 110. In some arrangements, the F-bracket 300 comprises an inner portion 330, an intermediate portion 340, a first outer portion 310, and a second outer portion 320. The inner portion 330, first outer portion 310, and second outer portion 320 can be integrally connected to the intermediate portion 340 to form a generally "F" shape. The term F-bracket 300 is used as a convenience herein and is not intended to limit the shape of the bracket 300 unless otherwise indicated. In some configurations, the overall shape of the bracket 300 is an "F" shape; however, the bracket 300 can also have additional portions such that the overall shape is other than F-shaped. For example, the bracket could have an "S" shape. Different types of brackets can be used in a single canopy to position the canopy frame elements as desired. An example of such brackets and bracket arrangements is described in U.S. patent application Ser. No. 14/149,538, filed Jan. 7, 2014 and published as U.S. Publ. No. 2014/0190541, and entitled CANOPY SHELTER BRACKETS, the entirety of which is incorporated by reference herein.

In one embodiment the inner portion 330, first outer portion 310, and second outer portion 320 comprise substantially rectangular projections from the intermediate portion 340 configured to pivotally couple to a cross member 110, 130. In some embodiments, the inner portion 330, first outer portion 310, and/or second outer portion 320 comprise curved shapes and/or rounded corners. In some configurations, at least a portion of the intermediate portion 340 defines a thickness that is greater than the thickness of the inner portion 330, the first outer portion 310 and/or the second outer portion 320. In some configurations, the intermediate portion 340 is generally or substantially triangular in shape from a top view.

With continued reference to FIG. 3A, in some configurations, the inner portion 330, first outer portion 310, and second outer portion 320 each has a hole formed therethrough to accept one or more fasteners, such as fasteners 210, 220. The inner portion 330 can be configured to receive the inner fastener 220 and pivotally couple the F-bracket 300 to the inner cross member 130. In some embodiments, the first outer portion 310 and the second outer portion 320 are configured to receive the outer fastener 210 and pivotally couple the F-bracket 300 to the first and second outer cross member 110. In some embodiments, a single fastener 210 can be used to couple a single outer cross member 110 to a bracket. In some configurations, the inner portion 330 is generally or substantially perpendicular to the first outer portion 310 and the second outer portion 320. In some configurations, the first outer portion 310 is generally or substantially parallel to the second outer portion 320. In some configurations, the F-bracket 300 is configured to maintain a generally or substantially perpendicular relationship between the inner cross member 130 and one or both the first outer cross member 110 and second outer cross member 110.

In one embodiment, the bracket 300 is monolithic in construction. In other embodiments, however, the brackets may be constructed of multiple pieces joined together (not illustrated). In one embodiment, the brackets may be constructed of an assortment of materials, for example, rubber, plastic, thermoplastic, thermoset, acrylonitrile butadiene styrene, polycarbonate alloy, acetal, acrylic, nylon, polybutylene terephthalate, polyester liquid crystal polymer, polypropylene, polycarbonate, polyimide, polythelene, steel, stainless steel, aluminum, titanium, or another metal material, and/or any other connection method or system. In one embodiment, the brackets are formed in an injection molded process. However, the brackets can be formed used any other production method or technique, as desired or required. In one embodiment, the material may be reinforced with glass or carbon fibers. In some embodiments, the brackets may be formed through an extrusion process. In one embodiment, the brackets may be formed by bending a flat piece of material. In one embodiment, the brackets are coated with one or more coatings or layers to prevent or help protect against corrosion, as desired or required.

In the illustrated arrangement, at least one of the outer cross members 110 includes an end portion 400 having an abutting or abutment member, portion or extension 402 that extends toward or to the adjacent cross member of the frame. The abutment member or portion 402 can be advantageously sized, shaped and/or otherwise configured to fill a space created between the outer cross members 110 by the bracket 300 and, in particular, the first outer portion 310 of the bracket 300 that is positioned between the outer cross members 110.

Accordingly, in some embodiments, in response to forces (e.g., lateral forces) applied to the outer cross members 110 (e.g., by wind, intentional or inadvertent pushing, etc.), the abutment member or portion 402 can contact the opposite cross member 110 to provide additional amount of lateral rigidity to the cross members 110 and the canopy frame 110 as a whole. That is, instead of only the fastener 210 resisting lateral forces, the fastener 210 and contact between the abutment member or portion 402 and the opposite cross member 110 both resist lateral forces and increase the resistance to lateral movement of the cross members 110. In some configurations, the abutment member or portion 402 contacts the opposite cross member 110 (or a portion thereof, such as an endcap). However, in other configurations, the abutment member 402 fills a portion of the gap between the cross members 110 and contacts the opposite cross member 110 in response to some lateral movement therebetween. However, in some embodiments, the abutment member 402 extends at least one-half (e.g., one-half, two-thirds, three-quarters, seven-eighths, lengths between the foregoing, etc.) of the distance between the cross members 110 such that the abutment member or portion 402 contacts the opposite cross member 110 without requiring excessive lateral movement. In some configurations, the abutment member or portion 402 has a thickness in a direction toward the opposite cross member 110 that is at least one-half (e.g., one-half, two-thirds, three-quarters, seven-eighths, thicknesses between the foregoing, etc.) of a thickness of a portion of the bracket 300, such as the first outer portion 310 of the bracket 300, as desired or required.

Figure 3B:
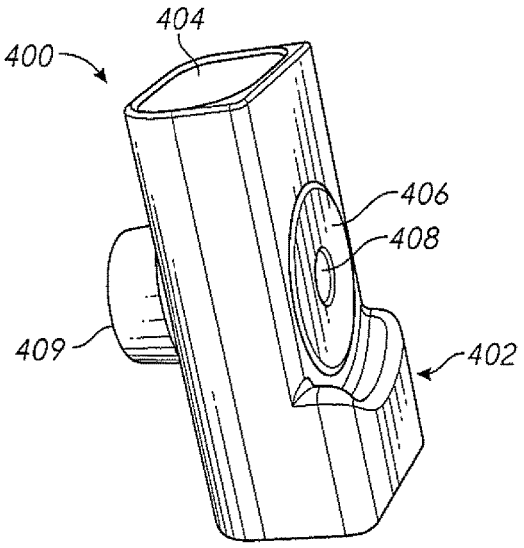
FIGS. 3B to 3D illustrate different views of one embodiment of an end portion assembly that is configured to be incorporated into one or more portions of a canopy structure.
Figure 3C:
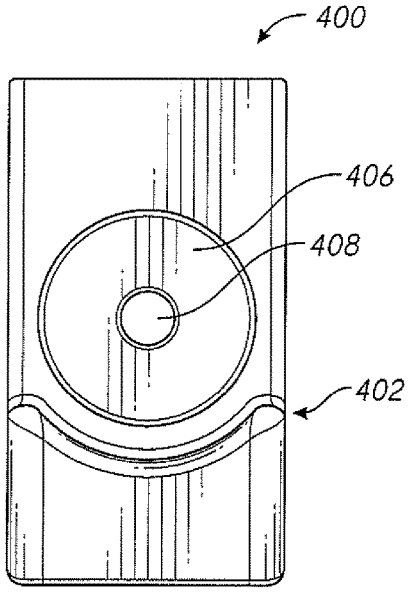
Figure 3D:
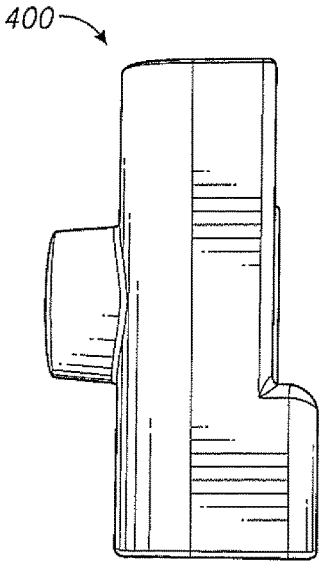

FIGS. 3B to 3D illustrate different views of one embodiment of an end portion assembly 400 that can be incorporated into one or more portions of a canopy structure. As shown, the end portion 400 can include a first end 404 for receiving a canopy frame member. Thus, in some embodiments, the end portion comprises a recess or other opening sized, shaped and configured to receive a corresponding member of the frame assembly. Further, as illustrated in FIGS. 3B to 3D and discussed in greater detail above, the end portion 400 can include an abutment member or portion 402 that extends beyond the adjacent surfaces or portions of the end portion 400. As shown, the abutment member or portion 402 can include a circular or rounded shape (e.g., to accommodate for rotation of the adjacent frame member to which the abutment member or portion 402 is secured).

With continued reference to FIGS. 3B to 3D, the end portion 400 can include an opening 408 that is used to connect (e.g., rotatably connect) the end portion to an adjacent member of the frame. In some embodiments, the opening 408 can extend to an opposite end 409 of the end portion 400. In some embodiments, the opening 408 is located along a raised surface or portion 406 of the end portion. Such a configuration can assist with the relative rotation of the end portion 400 relative to an adjacent frame member that is secured (e.g., rotatably secured) to the end portion, as desired or required.

As described herein, in some configurations, the frame 100 comprises a plurality of leg assemblies or legs 60 that support the upper portion of the frame 100 and the cover 52. The legs 60 can be multi-portion, telescopic legs having multiple leg members that extend and retract relative to one another. In some configurations, the legs 60 include at least three telescoping leg members, including an upper or outer leg 62, an intermediate leg 64 and a lower or inner leg 66. FIGS. 4A to 8 illustrate one embodiment of an automatic lock release 500 for the leg assembly 600. In some embodiments, the automatic release 500 is configured to release one or more locks (e.g., push pin locks, other spring-activated locks, etc.) situated between adjacent pairs of the legs 62, 64, 66. In the illustrated arrangement, once activated, the automatic release 500 releases a lock mechanism (e.g., a push pin lock) between the intermediate leg 64 and the lower leg 66. In some embodiments, once the automatic release 500 is activated (e.g., permitted to move downwardly), adjacent locks or engagement members (e.g., that hold or otherwise retain one leg member fixed relative to another leg member) can be advantageously released with a single motion. This can allow legs (e.g., canopy legs) that incorporate such a release 500 to be quickly and easily collapsed (e.g., the various telescoping leg portions to be collapsed into a shorter configuration). For example, with reference to FIG. 4A, in some embodiments, allowing the top leg portion or segment 62 to move downwardly relative to immediately lower leg portion or segment 64 (e.g., by manipulating the push pin lock or other type of lock 63) can permit an automatic release 500 located along the bottom of the top leg portion or segment 62 to release any additional locks included on the leg 60 (e.g., the push pin lock 65 located along the lower end of the intermediate leg portion or segment 64) without the need to release or otherwise manipulate (e.g., press a push pin lock) such lower locks. As a result, the leg portions or segments 64, 66 situated below the top leg portion or segment (and thus, the release 500) can telescopically collapse.

Figure 4A:
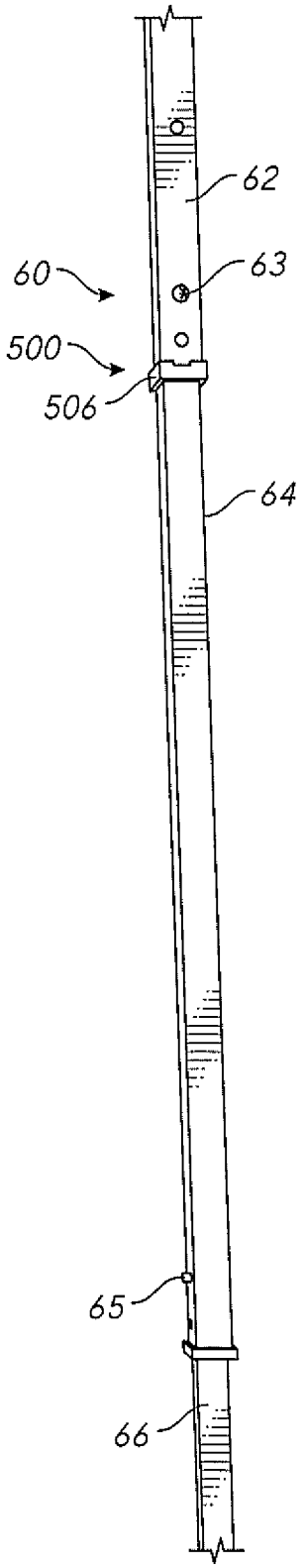
FIG. 4A illustrates a front perspective view of a telescopic leg comprising a lock release member according to one embodiment.
Figure 4B:
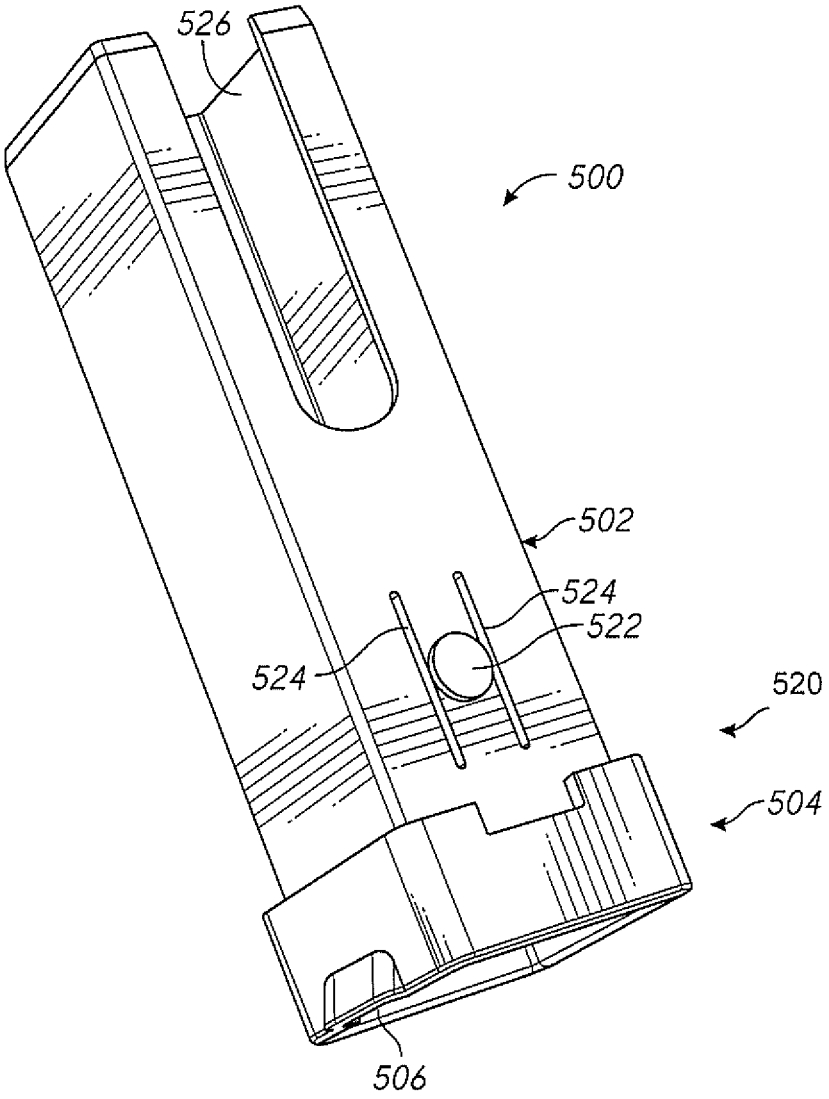
FIG. 4B illustrates a perspective view of an automatic lock release component.
Figure 8:
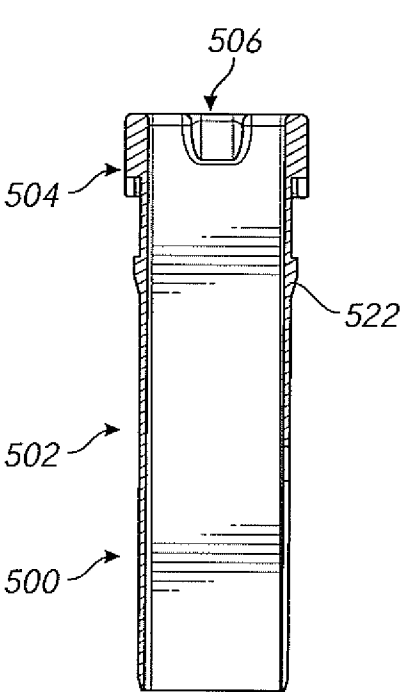
FIG. 8 illustrates a second sectional view of the automatic lock release component of FIG. 4B.
Figure 7:
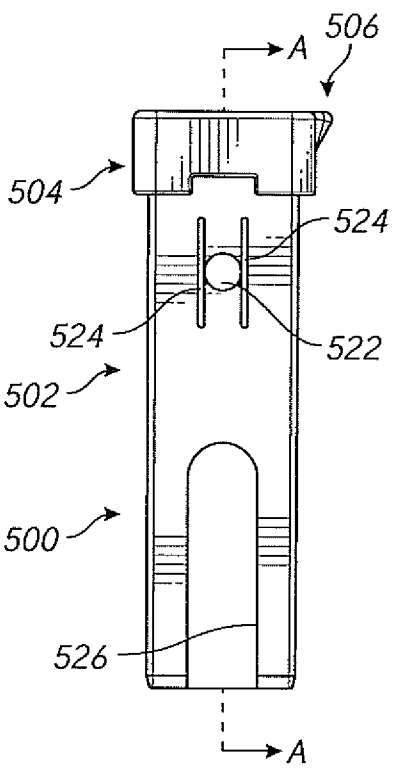
FIG. 7 illustrates a second side view of the automatic lock release component of FIG. 4B.
Figure 5:
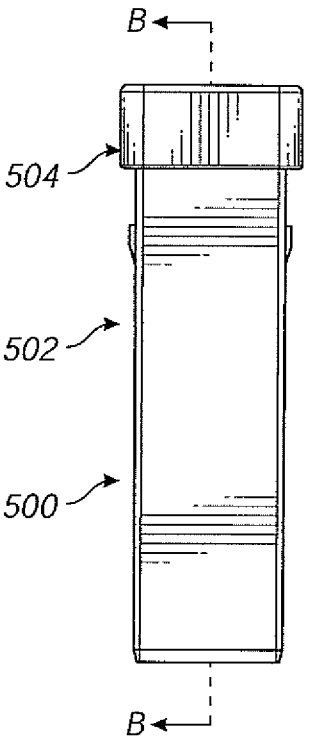
FIG. 5 illustrates a first side view of the automatic lock release component of FIG. 4B.
Figure 6:
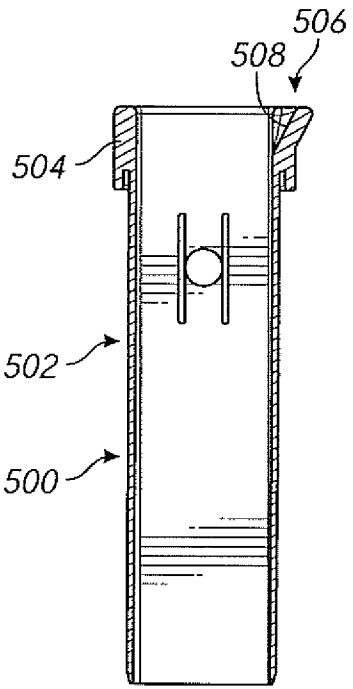
FIG. 6 illustrates a first sectional view of the automatic lock release component of FIG. 4B.

According to some embodiments, the automatic release 500 comprises a hollow body 502 (e.g., at least partially hollow) that is received within the lower end of the upper leg segment or portion 62 and allows the intermediate leg segment or portion 64 to pass, at least partially, through the body 502. In some arrangements, as illustrated in FIG. 4B, an end cap portion 504 is exterior the lower end of the upper leg 62. The end cap portion 504 defines a recess 506 having an open lower end that leads to a ramped, sloped, angled or other tapered surface 508 that extends from a point relatively outward of the legs 62, 64 to a point relative closer to the legs 62, 64 in a direction going from the open lower end of the recess toward the body 502. Thus, as the upper leg or leg portion or member 62 is moved downward toward the lower end of the intermediate leg or leg portion or member 64, the automatic release 500 approaches the pin or other release member (e.g., pop pin, other spring-activated pin, etc.) of the push pin lock mechanism that secures the intermediate leg member or portion 64 relative to the lower leg member or portion 66. The pin (e.g., pop pin) enters the open lower end of the recess 506 and contacts the ramped or sloped surface 508. Further downward movement of the automatic release 500 (via movement of the upper leg 62) pushes in and disengages the pop pin as a result of interaction between the ramped surface 508 and the pop pin. Height adjustment can be accomplished between the upper leg 62 and intermediate leg 64. Thus, the upper leg 62 can be manually released relative to the intermediate leg 64 and moved downwardly to automatically release the lock between the intermediate leg 64 and the lower leg 66. Legs 60 having three or more stages can collapse to a smaller height dimension than legs having only two stages, which allows the canopy 50 to be more compact when collapsed.

The automatic release 500 can have one or more additional features, such as, for example, a retention arrangement 520, which assists in retaining the release body 502 within the upper leg 62. The illustrated retention arrangement 520 includes a protrusion 522 that contacts the inner surface of the upper leg 62 to increase the retention force of the release body 502. In some configurations, one or more slots 524 can be positioned near the protrusion 522 to permit inward flex of the body 502 to ease entry of the protrusion 522 into the upper leg 62. In the illustrated arrangement, the slots 524, which extend in a longitudinal direction, are placed on each side of the protrusion 522 and are substantially adjacent to the protrusion 522. The release body 502 can also include an elongate slot 526 that extends in a longitudinal direction of the body 502 and can accommodate portions of a lock mechanism (e.g., a push pin lock) for locking the folding eaves in a locked position. That is, in some embodiments, the slot 526 can accommodate a locking pin, for example, of a sliding bracket attached to a lower, outer cross member 110 and that slides on the upper leg 62 to collapse and deploy the canopy 50.

Figure 9:
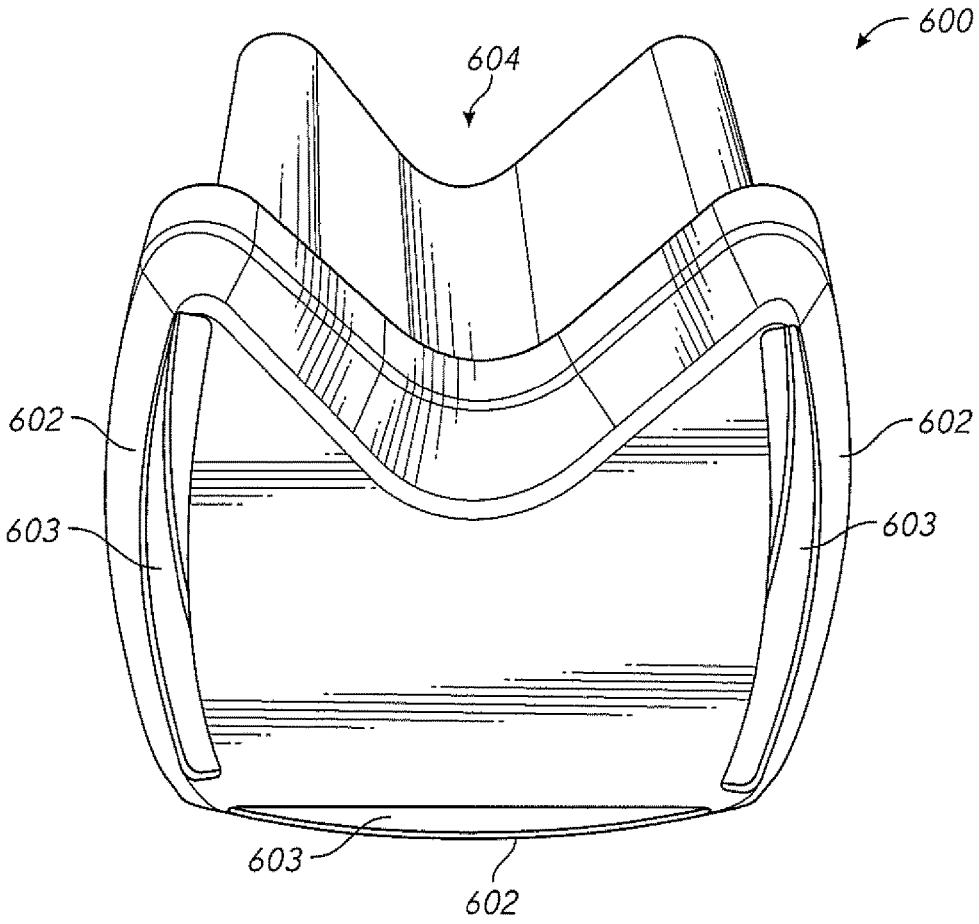
FIG. 9 illustrates a first perspective view of an end cap for an interior end of a relative inner leg.
Figure 10:
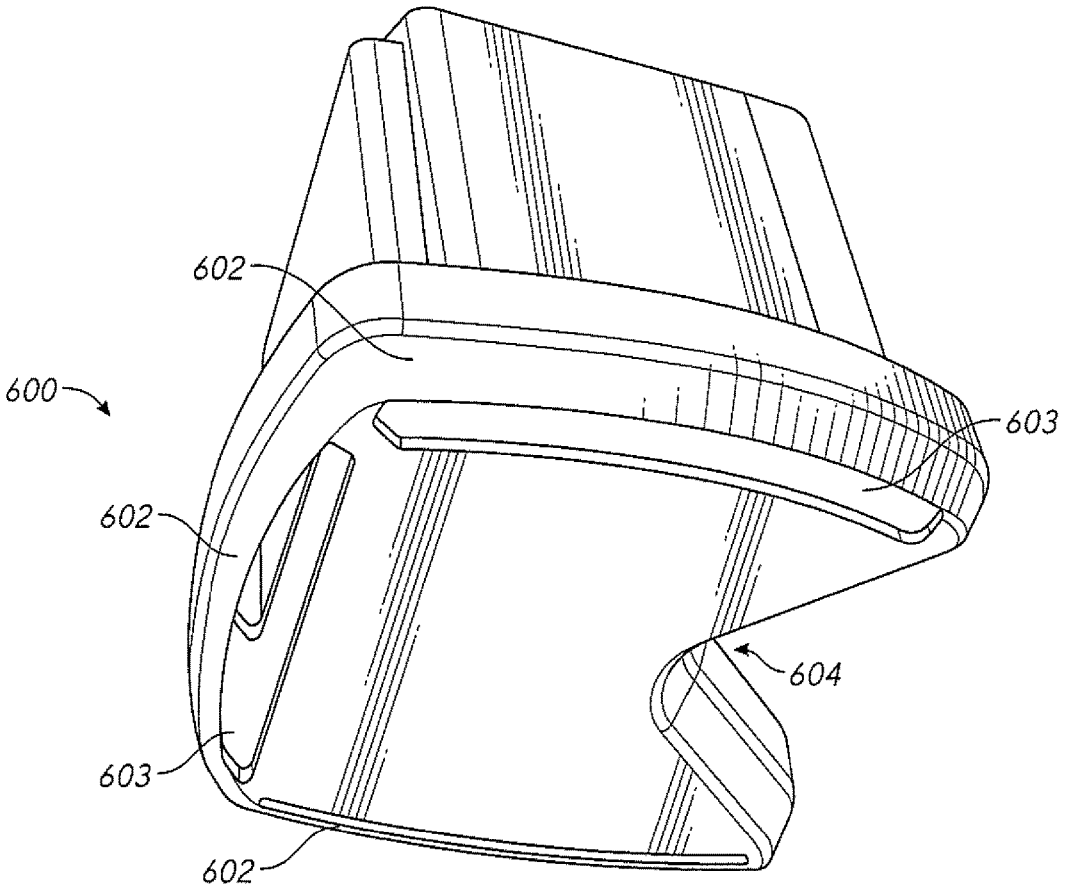
FIG. 10 illustrates a second perspective view of the end cap of FIG. 9.
Figure 11:
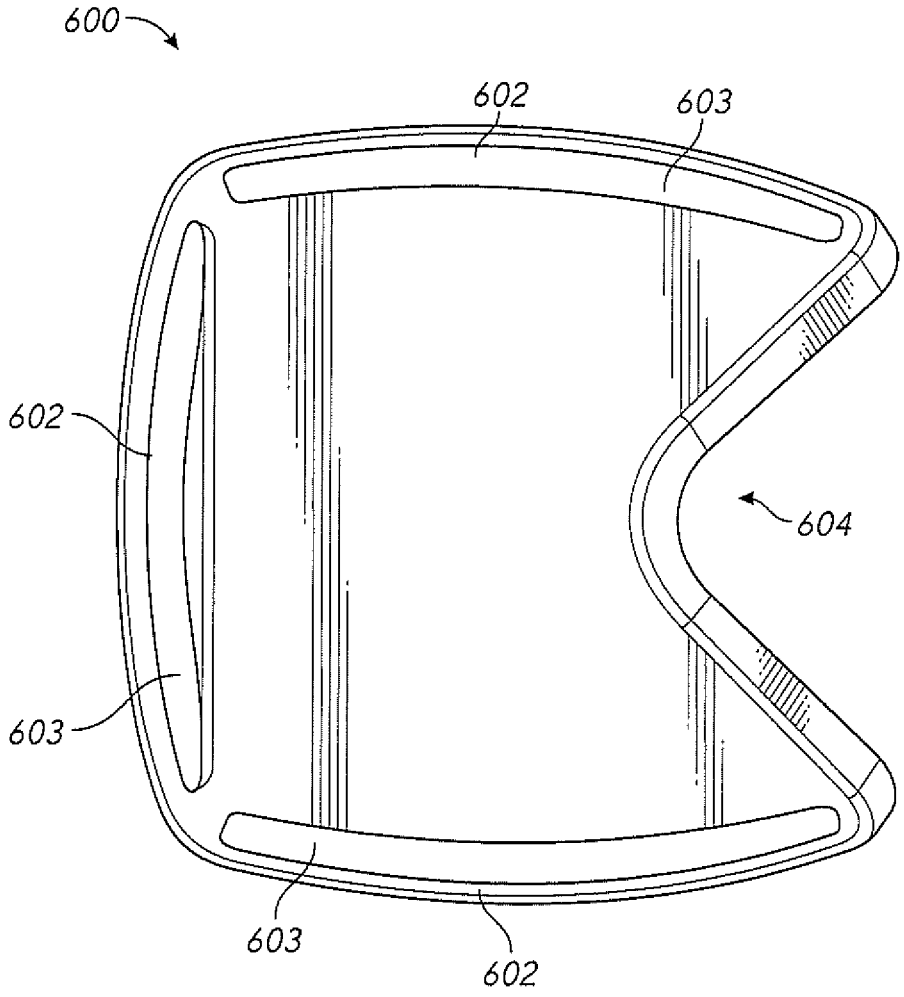
FIG. 11 illustrates a top view of the end cap of FIG. 9.

FIGS. 9 to 11 illustrate one embodiment of a cap 600 that is carried by or otherwise position along an upper end of a relatively inner leg 64, 66 and that contacts an interior surface of a relatively outer leg 62, 64. As discussed in greater detail herein, such a cap 600 can help create a tighter clearance or fit between adjacent legs or leg members when such legs or legs members are slidably positioned relative to each other. In some embodiments, the cap 600 includes one or more resilient portions 602 that can move inwardly toward a center of the cap 600 and provide a resilient force against such inward movement. The resilient portions 602 can have an outer surface that contacts the interior surface of the relatively outer leg 62, 64. Preferably, the outer surface is configured to be positioned outwardly of an outer surface of the relatively inner leg 64, 66 to which the cap 600 is attached. With such an arrangement, the resilient portions 602 contact and apply a resilient force against the interior surface of the relatively outer leg 62, 64 to take up at least a portion of play present between the legs to which the cap 600 is attached and within which the cap 600 is positioned. As illustrated in FIGS. 9 to 11, the resilient portions 602 can be formed by creating or otherwise positioning gaps 603 along one or more perimeter edges of the cap 600. In some configurations, the cap 600 can include a recess 604 to accommodate structures within the leg 60 that the cap 600 may pass between an extended and retracted position, such as a push pin lock arrangement between the upper leg 62 and the intermediate leg 64 when the cap 600 is carried by the lower leg 66, for example.

In the illustrated arrangement, the resilient portions 602 (and thus, in some embodiments, the corresponding gaps 603 or other features that help create the resilient portions) extend along one or more perimeter edges or sides of the cap 600. The portions 602 can be positioned on one, two, three, four or more sides of the cap 600. In the illustrated arrangement, the resilient portions 602 are coupled to the body of the cap 600 at corners and are spaced from the body along the sides of the cap 600. However, other suitable arrangements are also possible. For example, the resilient portions can take on any suitable form to apply a suitable force to the interior surface of a leg within which the cap 600 is inserted, preferably while allowing relatively easy insertion of the cap 600 into the leg for manufacturing purposes. Thus, while the illustrated resilient portions 602 are coupled to the body of the cap 600 at two locations (e.g., ends), in other arrangements the resilient portions 602 can be coupled at only one location or more than two locations.

As noted above, the use of such inwardly resilient caps 600 along an end of an interior leg or leg segment or portion can help ensure that adjacent legs are tightly or snugly maintained, especially when the legs are extended relative to one another. Thus, this can help enhance stability of an extended leg, reduce unwanted movement between adjacent leg segments and/or provide one or more additional benefits or advantages. At the same time, the cap's resiliency (e.g., its ability to retract at least partially inwardly) can permit the leg segments or portions to be selectively moved relative to one another (e.g., during extension or retraction of a leg).

The systems, apparatuses, devices and/or other articles disclosed herein may be formed through any suitable means. The various methods and techniques described above provide a number of ways to carry out the inventions. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Although several embodiments and examples are disclosed herein, the present application extends beyond the specifically disclosed embodiments to other alternative embodiments and/or uses of the inventions and modifications and equivalents thereof. It is also contemplated that various combinations or subcombinations of the specific features and aspects of the embodiments may be made and still fall within the scope of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

While the embodiments disclosed herein are susceptible to various modifications, and alternative forms, specific examples thereof have been shown in the drawings and are herein described in detail. It should be understood, however, that the inventions are not to be limited to the particular forms or methods disclosed, but, to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "providing" include "instructing providing." The ranges disclosed herein also encompass any and all overlap, subranges, and combinations thereof. Language such as "up to," "at least," "greater than," "less than," "between," and the like includes the number recited. Numbers preceded by a term such as "about" or "approximately" include the recited numbers. For example, "about 10 mm" includes "10 mm." Terms or phrases preceded by a term such as "substantially" include the recited term or phrase. For example, "substantially parallel" includes "parallel."

What is claimed is:

1. A collapsible canopy, comprising: a collapsible frame comprising at least one telescopic leg, the at least one telescopic leg comprising a first leg segment, a second leg segment and at least a third leg segment; wherein the second leg segment is situated below the first leg segment and is configured to slide at least partially within an interior of the first leg segment; wherein the third leg segment is situated below the second leg segment and is configured to slide at least partially within an interior of the second leg segment; a first lock positioned along or near a lower end of the first leg segment, the first lock being configured to lockingly engage the first leg segment relative to the second leg segment; a second lock positioned along or near a lower end of the second leg segment, the second lock being configured to lockingly engage the second leg segment relative to the third leg segment; a collapsible canopy cover supported by the collapsible frame; and an automatic lock release that comprises a hollow body received at least partially within the lower end of the first leg segment, wherein the automatic lock release is configured to release the second lock once the first lock is released and the second leg segment slidably moves within the first leg segment.

2. The canopy of claim 1, wherein the automatic lock release is configured to release the second lock when the automatic lock release at least partially contacts the second lock.

3. The canopy of claim 1, wherein the second lock comprises a push pin lock, wherein the automatic lock release is configured to activate the push pin lock upon contact between the automatic lock release and the second lock so as to permit relative movement between the second leg segment and the third leg segment.

4. The canopy of claim 1, wherein the automatic lock release comprises a protruding member, wherein the protruding member extends at least partially out of the lower end of the first leg segment and is configured to contact and engage at least a portion of the second lock.

5. The canopy of claim 4, wherein the protruding member comprises a ramped, sloped, angled or other tapered surface.

6. The canopy of claim 4, wherein the protruding member includes a recess that leads to the ramped, sloped, angled or other tapered surface and is situated along the same side of the at least one telescopic leg as the second lock.

7. The canopy of claim 4, wherein the first lock is situated along a different side of the at least one telescopic leg than the second lock.

8. The canopy of claim 1, wherein the collapsible frame comprises four telescopic legs, wherein each of said telescopic legs comprises an automatic lock release along a first leg portion of said telescopic leg.

9. A collapsible canopy, comprising: a collapsible frame comprising at least one telescopic leg, the at least one telescopic leg comprising a first leg segment, a second leg segment and at least a third leg segment; wherein the second leg segment is situated below the first leg segment and is configured to slide at least partially within an interior of the first leg segment; wherein the third leg segment is situated below the second leg segment and is configured to slide at least partially within an interior of the second leg segment; a first lock positioned along or near a lower end of the first leg segment, the first lock being configured to lockingly engage the first leg segment relative to the second leg segment; a second lock positioned along or near a lower end of the second leg segment, the second lock being configured to lockingly engage the second leg segment relative to the third leg segment; a lock release assembly that comprises a hollow body received at least partially within the lower end of the first leg segment, wherein the lock release assembly is configured to release said second lock once the first lock is released thereby permitting the third leg segment to move relative to the second leg segment.

10. The canopy of claim 9, wherein the lock release assembly is configured to release the second lock when the lock release assembly at least partially contacts the second lock.

11. The canopy of claim 9, wherein the second lock comprises a push pin lock, wherein the lock release assembly is configured to activate the push pin lock upon contact between the lock release assembly and the second lock so as to permit relative movement between the second leg segment and the third leg segment.

12. The canopy of claim 9, wherein the lock release assembly comprises a protruding member, wherein the protruding member is configured to contact and engage at least a portion of the second lock.

13. The canopy of claim 12, wherein the protruding member extends at least partially out of the lower end of the first leg segment and comprises a ramped, sloped, angled or other tapered surface.

14. The canopy of claim 12, wherein the protruding member includes a recess that leads to the ramped, sloped, angled or other tapered surface and is situated along the same side of the at least one telescopic leg as the second lock.

* * * * *